US007011047B2

(12) United States Patent
Aarnio et al.

(10) Patent No.: US 7,011,047 B2
(45) Date of Patent: Mar. 14, 2006

(54) DETONATIVE CLEANING APPARATUS

(75) Inventors: Michael J. Aarnio, Kirkland, WA (US); Donald W. Kendrick, Bellevue, WA (US); Thomas R. A. Bussing, Sammamish, WA (US)

(73) Assignee: United Technologies Corporation, Hartford, CT (US)

( * ) Notice: Subject to any disclaimer, the term of this patent is extended or adjusted under 35 U.S.C. 154(b) by 202 days.

(21) Appl. No.: 10/718,730

(22) Filed: Nov. 20, 2003

(65) Prior Publication Data

US 2005/0112516 A1 May 26, 2005

(51) Int. Cl.
*F22B 37/48* (2006.01)

(52) U.S. Cl. ..... 122/379; 122/396; 165/95; 134/22.1

(58) Field of Classification Search ..... 122/379, 122/390, 395, 396, 405; 134/184, 22.1, 1, 134/166 R, 169 R; 165/95
See application file for complete search history.

(56) References Cited

U.S. PATENT DOCUMENTS 5,082,502 A 1/1992 Lee et al.
5,430,691 A 7/1995 Fridman
5,494,004 A 2/1996 Hunter, Jr.
5,741,130 A * 4/1998 Hagstrom et al. ..... 432/2
5,769,034 A * 6/1998 Zilka et al. ..... 122/379
5,864,517 A * 1/1999 Hinkey et al. ..... 367/145
6,438,191 B1 8/2002 Bickes, Jr. et al.
6,446,428 B1 * 9/2002 Kaemming et al. ..... 60/247
6,644,201 B1 * 11/2003 Zilka et al. ..... 102/302
6,684,823 B1 2/2004 Plavnik et al.
2002/0112638 A1 8/2002 Zika et al.
2004/0112306 A1 6/2004 Ruegg

FOREIGN PATENT DOCUMENTS

WO WO 01/78912 A1 10/2001
YU P 1756/88 6/1990
YU P 1728/88 2/1992

OTHER PUBLICATIONS

Hanjalic et al., "Detonation-Wave Technique for On-Load Deposit . . . ", Journal of Engineering for Gas Turbines and Power, Jan., 1994, pp. 223-236. vol. 118.
Huque, "Experimental Investigation of Slag Removal Using . . . ", Annual Symposium, Mar. 16-18, 1999, pp. 1-6, Miami, FL.
Hanjalic et al., "Further Experience in Using Detonation Waves . . . ", International Journal of Energy Research, Apr. 7, 1993, pp. 583-595, vol. 17.

* cited by examiner

*Primary Examiner*—Gregory Wilson
(74) *Attorney, Agent, or Firm*—Bachman & LaPointe, P.C.

(57) ABSTRACT

Methods and apparatus are provided for cleaning a surface within a vessel. A fuel/oxidizer charge is provided within a combustion conduit. An initial deflagration commenced in a first portion of the charge produces a final detonation at least in another portion of the charge to expel a shockwave from the conduit which impinges upon the surface. The deflagration-to-detonation transition may be encouraged by mechanical enhancements and/or by making the first charge portion more detonable than the second.

20 Claims, 6 Drawing Sheets

DETONATIVE CLEANING APPARATUS

FIELD OF THE INVENTION

The invention relates to industrial equipment. More particularly, the invention relates to the detonative cleaning of industrial equipment.

DESCRIPTION OF THE RELATED ART

Surface fouling is a major problem in industrial equipment. Such equipment includes furnaces (coal, oil, waste, etc.), boilers, gasifiers, reactors, heat exchangers, and the like. Typically the equipment involves a vessel containing internal heat transfer surfaces that are subjected to fouling by accumulating particulate such as soot, ash, minerals and other products and byproducts of combustion, more integrated buildup such as slag and/or fouling, and the like. Such particulate build-up may progressively interfere with plant operation, reducing efficiency and throughput and potentially causing damage. Cleaning of the equipment is therefore highly desirable and is attended by a number of relevant considerations. Often direct access to the fouled surfaces is difficult. Additionally, to maintain revenue it is desirable to minimize industrial equipment downtime and related costs associated with cleaning. A variety of technologies have been proposed. By way of example, various technologies have been proposed in U.S. Pat. Nos. 5,494,004 and 6,438,191 and U.S. patent application publication 2002/0112638. Additional technology is disclosed in Huque, Z. Experimental Investigation of Slag Removal Using Pulse Detonation Wave Technique, DOE/HBCU/OMI Annual Symposium, Miami, Fla., Mar. 16–18, 1999. Particular blast wave techniques are described by Hanjalić and Smajević in their publications: Hanjalić, K. and Smajević, I., Further Experience Using Detonation Waves for Cleaning Boiler Heating Surfaces, International Journal of Energy Research Vol. 17, 583–595 (1993) and Hanjalić, K. and Smajević, I., Detonation-Wave Technique for On-load Deposit Removal from Surfaces Exposed to Fouling: Parts I and II, Journal of Engineering for Gas Turbines and Power, Transactions of the ASME, Vol. 1, 116 223–236, January 1994. Such systems are also discussed in Yugoslav patent publications P 1756/88 and P 1728/88. Such systems are often identified as "soot blowers" after an exemplary application for the technology.

Nevertheless, there remain opportunities for further improvement in the field.

SUMMARY OF THE INVENTION

Accordingly, one aspect of the invention involves an apparatus for cleaning a surface within a vessel. The vessel has a wall separating an exterior from an interior and having a wall aperture. The apparatus has an elongate conduit having upstream and downstream first and second ends. The conduit is positioned to direct a shockwave from the second end into the vessel interior. A source of fuel and oxidizer is coupled to the conduit to deliver fuel and oxidizer to the conduit. The conduit has a first portion and a second portion downstream of the first portion. The first and second portions have first and second characteristic cross-sectional areas, the second greater than the first. An initiator is positioned to initiate a deflagration in the first portion of the fuel and oxidizer. The conduit first and second portions are positioned to permit a deflagration-to-detonation transition from the deflagration to produce the shockwave.

In various implementations, the source may include first fuel and oxidizer sources of a first fuel and oxidizer and second fuel and oxidizer sources of a second fuel and oxidizer. The second fuel and oxidizer sources may be coupled to the conduit downstream of where the first fuel and oxidizer sources are coupled. The conduit second portion may include a number of conduit sections secured end-to-end and being of essentially constant characteristic internal diameter. The conduit first portion may include an upstream portion of essentially constant characteristic internal diameter and a downstream portion having an essentially downstream increasing internal diameter. The conduit first and/or second portions may have an internal surface area enhancement. The first portion of the fuel and oxidizer may be a minor portion and may be more detonable than a major second portion.

Another aspect of the invention involves a vessel cleaning apparatus having an elongate conduit with upstream and downstream first and second ends. The conduit is positioned to direct a shockwave from the second end into the vessel interior. The apparatus includes means for introducing first and second fuel/oxidizer mixtures to the conduit and initiating a deflagration of the first mixture so as to produce a deflagration-to-detonation transition from the deflagration and detonate the second mixture to produce the shockwave.

In various implementations, the oxidizer of the first mixture may be more oxygen-rich than the oxidizer of the second mixture. The second fuel/oxidizer mixture may be different from the first fuel/oxidizer mixture in chemistry or proportion. The means may include a number of changes in conduit internal transverse cross-sectional area.

Another aspect of the invention involves a method for cleaning a surface within a vessel. A first fuel/oxidizer mixture is provided in a first conduit portion. A second fuel/oxidizer mixture, different from the first in chemistry or proportion is provided in a second conduit portion. A reaction of the first fuel/oxidizer mixture is initiated so as to, in turn, cause a detonation of the second/oxidizer mixture so as to cause a shockwave to impinge upon the surface.

In various implementations, the reaction of the first fuel/oxidizer mixture may include a deflagration-to-detonation transition. The second mixture may be less detonable than the first. The oxidizer of the second mixture may be less oxygen-rich than the oxidizer of the first. The first fuel/oxidizer mixture may be introduced to the first conduit portion as separate fuel and oxidizer components. The second fuel/oxidizer mixture may be introduced premixed to the second conduit portion. The conduit may be purged with a purge gas. The first conduit portion may have a characteristic cross-sectional area less than a characteristic cross-sectional area of the second conduit portion. A major portion of the first fuel/oxidizer mixture may be provided before or after a major portion of the second is provided.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
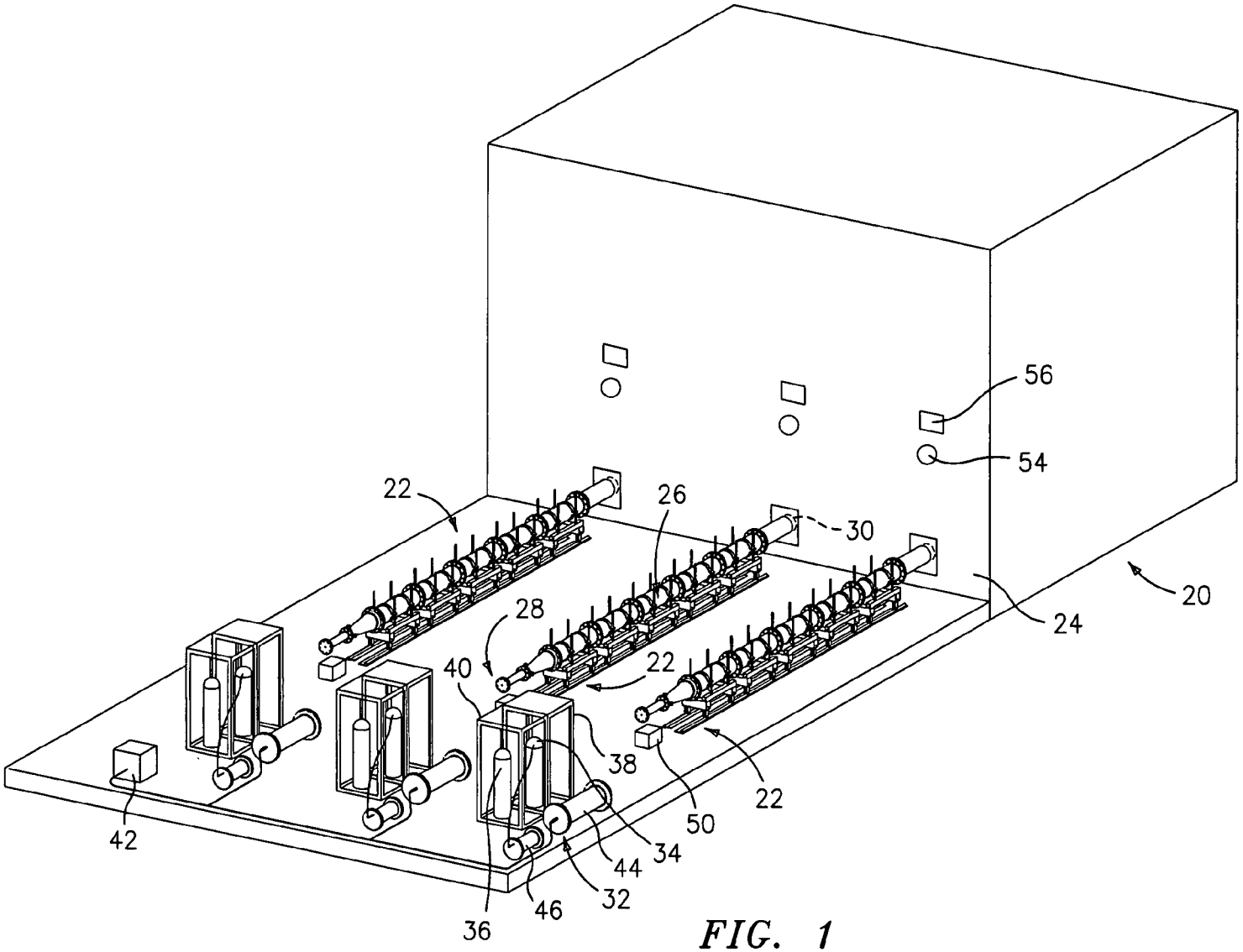
FIG. 1 is a view of an industrial furnace associated with several soot blowers positioned to clean a level of the furnace.

FIG. 1 shows a furnace 20 having an exemplary three associated soot blowers 22. In the illustrated embodiment, the furnace vessel is formed as a right parallelepiped and the soot blowers are all associated with a single common wall 24 of the vessel and are positioned at like height along the wall. Other configurations are possible (e.g., a single soot blower, one or more soot blowers on each of multiple levels, and the like).

Each soot blower 22 includes an elongate combustion conduit 26 extending from an upstream distal end 28 away from the furnace wall 24 to a downstream proximal end 30 closely associated with the wall 24. Optionally, however, the end 30 may be well within the furnace. In operation of each soot blower, combustion of a fuel/oxidizer mixture within the conduit 26 is initiated proximate the upstream end (e.g., within an upstreammost 10% of a conduit length) to produce a detonation wave which is expelled from the downstream end as a shock wave along with associated combustion gases for cleaning surfaces within the interior volume of the furnace. Each soot blower may be associated with a fuel/oxidizer source 32. Such source or one or more components thereof may be shared amongst the various soot blowers. An exemplary source includes a liquefied or compressed gaseous fuel cylinder 34 and an oxygen cylinder 36 in respective containment structures 38 and 40. In the exemplary embodiment, the oxidizer is a first oxidizer such as essentially pure oxygen. A second oxidizer may be in the form of shop air delivered from a central air source 42. In the exemplary embodiment, air is stored in an air accumulator 44. Fuel, expanded from that in the cylinder 34 is generally stored in a fuel accumulator 46. Each exemplary source 32 is coupled to the associated conduit 26 by appropriate plumbing below. Similarly, each soot blower includes a spark box 50 for initiating combustion of the fuel oxidizer mixture and which, along with the source 32, is controlled by a control and monitoring system (not shown). FIG. 1 further shows the wall 24 as including a number of ports for inspection and/or measurement. Exemplary ports include an optical monitoring port 54 and a temperature monitoring port 56 associated with each soot blower 22 for respectively receiving an infrared and/or visible light video camera and thermocouple probe for viewing the surfaces to be cleaned and monitoring internal temperatures. Other probes/monitoring/sampling may be utilized, including pressure monitoring, composition sampling, and the like.

Figure 2:
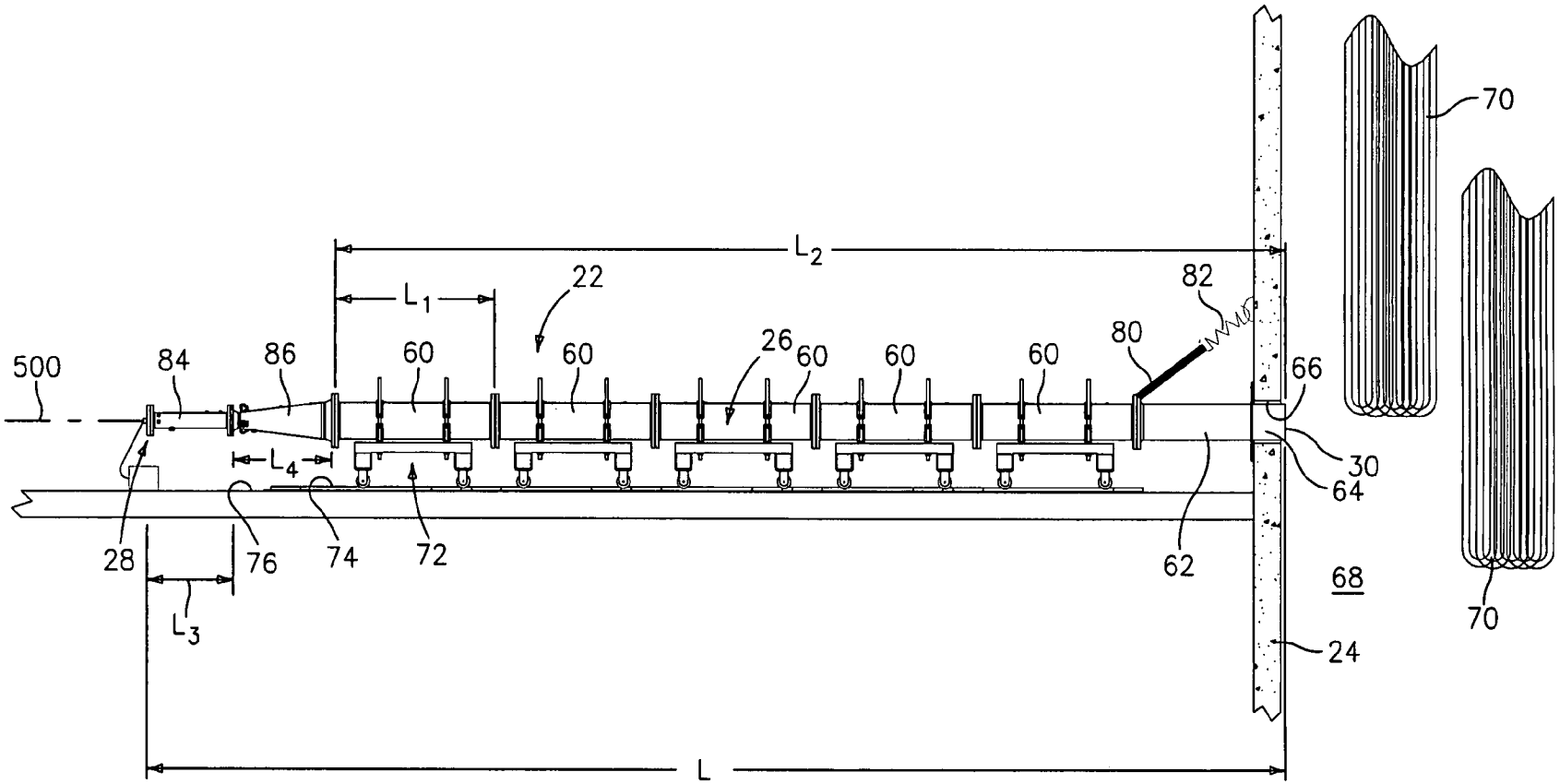
FIG. 2 is a side view of one of the blowers of FIG. 1.

FIG. 2 shows further details of an exemplary soot blower 22. The exemplary detonation conduit 26 is formed with a main body portion formed by a series of doubly flanged conduit sections or segments 60 arrayed from upstream to downstream and a downstream nozzle conduit section or segment 62 having a downstream portion 64 extending through an aperture 66 in the wall and ending in the downstream end or outlet 30 exposed to the furnace interior 68. The term nozzle is used broadly and does not require the presence of any aerodynamic contraction, expansion, or combination thereof. The outlet 30 may be located further within the furnace if appropriate support and cooling are provided. FIG. 2 further shows furnace interior tube bundles 70, the exterior surfaces of which are subject to fouling. In the exemplary embodiment, each of the conduit segments 60 is supported on an associated trolley 72, the wheels of which engage a track system 74 along the facility floor 76. The exemplary track system includes a pair of parallel rails engaging concave peripheral surfaces of the trolley wheels. The exemplary segments 60 are of similar length $L_1$ and are bolted end-to-end by associated arrays of bolts in the bolt holes of their respective flanges. Similarly, the downstream flange of the downstreammost of the sections 60 is bolted to the upstream flange of the nozzle 62. In the exemplary embodiment, a reaction strap 80 (e.g., cotton or thermally/structurally robust synthetic) in series with one or more metal coil reaction springs 82 is coupled to this last mated flange pair and connects the combustion conduit to an environmental structure such as the furnace wall for resiliently absorbing reaction forces associated with discharging of the soot blower and ensuring correct placement of the combustion conduit for subsequent firings. Optionally, additional damping (not shown) may be provided. The reaction strap/spring combination may be formed as a single length or a loop. In the exemplary embodiment, this combined downstream section has an overall length $L_2$.

Extending downstream from the upstream end 28 is a predetonator conduit section/segment 84 which also may be doubly flanged and has a length $L_3$. The predetonator conduit segment 84 has a characteristic internal cross-sectional area (transverse to an axis/centerline 500 of the conduit) which is smaller than a characteristic internal cross-sectional area (e.g., mean, median, mode, or the like) of the downstream portion (60, 62) of the combustion conduit. In an exemplary embodiment involving circular sectioned conduit segments, the predetonator cross-sectional area is a characterized by a diameter of between 8 cm and 12 cm whereas the downstream portion is characterized by a diameter of between 20 cm and 40 cm. Accordingly, exemplary cross-sectional area ratios of the downstream portion to the predetonator segment are between 1:1 and 10:1, more narrowly, 2:1 and 10:1. An overall length L between ends 28 and 30 may be 1–15 m, more narrowly, 5–15 m. In the exemplary embodiment, a transition conduit segment 86 extends between the predetonator segment 84 and the upstreammost segment 60. The segment 86 has upstream and downstream flanges sized to mate with the respective flanges of the segments 84 and 60 has an interior surface which provides a smooth transition between the internal cross-sections thereof. The exemplary segment 86 has a length $L_4$. An exemplary half angle of divergence of the interior surface of segment 86 is $\leqq 12°$, more narrowly 5–10°.

Figure 3:
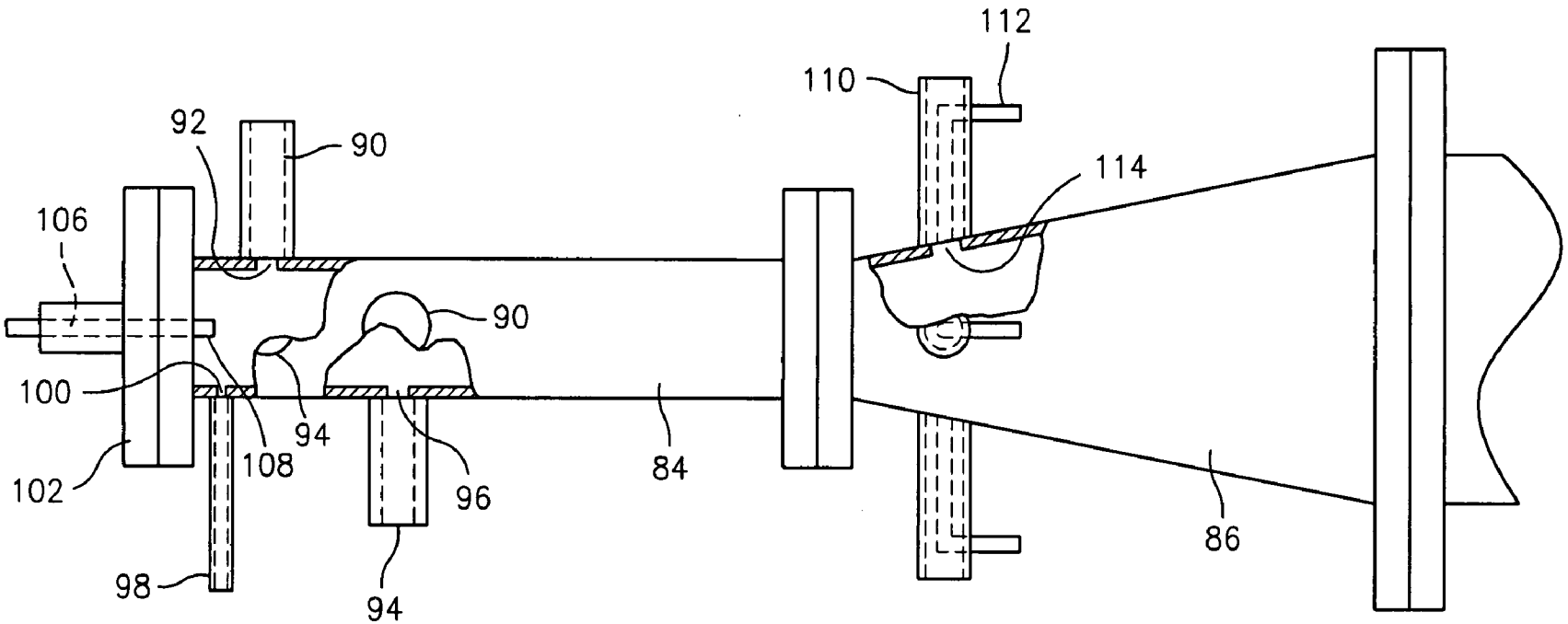
FIG. 3 is a partially cut-away side view of an upstream end of the blower of FIG. 2.

A fuel/oxidizer charge may be introduced to the detonation conduit interior in a variety of ways. There may be one or more distinct fuel/oxidizer mixtures. Such mixture(s) may be premixed external to the detonation conduit, or may be mixed at or subsequent to introduction to the conduit. FIG. 3 shows the segments 84 and 86 configured for distinct introduction of two distinct fuel/oxidizer combinations: a predetonator combination; and a main combination. In the exemplary embodiment, in an upstream portion of the segment 84, a pair of predetonator fuel injection conduits 90 are coupled to ports 92 in the segment wall which define fuel injection ports. Similarly, a pair of predetonator oxidizer conduits 94 are coupled to oxidizer inlet ports 96. In the exemplary embodiment, these ports are in the upstream half of the length of the segment 84. In the exemplary embodiment, each of the fuel injection ports 92 is paired with an associated one of the oxidizer ports 96 at even axial position and at an angle (exemplary 90° shown, although other angles including 180° are possible) to provide opposed jet mixing of fuel and oxidizer. Discussed further below, a purge gas conduit 98 is similarly connected to a purge gas port 100 yet further upstream. An end plate 102 bolted to the upstream flange of the segment 84 seals the upstream end of the combustion conduit and passes through an igniter/initiator 106 (e.g., a spark plug) having an operative end 108 in the interior of the segment 84.

In the exemplary embodiment, the main fuel and oxidizer are introduced to the segment 86. In the illustrated embodiment, main fuel is carried by a number of main fuel conduits 112 and main oxidizer is carried by a number of main oxidizer conduits 110, each of which has terminal portions concentrically surrounding an associated one of the fuel conduits 112 so as to mix the main fuel and oxidizer at an associated inlet 114. In exemplary embodiments, the fuels are hydrocarbons. In particular exemplary embodiments, both fuels are the same, drawn from a single fuel source but mixed with distinct oxidizers: essentially pure oxygen for the predetonator mixture; and air for the main mixture. Exemplary fuels useful in such a situation are propane, MAPP gas, or mixtures thereof. Other fuels are possible, including ethylene and liquid fuels (e.g., diesel, kerosene, and jet aviation fuels). The oxidizers can include mixtures such as air/oxygen mixtures of appropriate ratios to achieve desired main and/or predetonator charge chemistries. Further, monopropellant fuels having molecularly combined fuel and oxidizer components may be options.

In operation, at the beginning of a use cycle, the combustion conduit is initially empty except for the presence of air (or other purge gas). The predetonator fuel and oxidizer are then introduced through the associated ports filling the segment 84 and extending partially into the segment 86 (e.g., to near the midpoint) and advantageously just beyond the main fuel/oxidizer ports. The predetonator fuel and oxidizer flows are then shut off. An exemplary volume filled by the predetonator fuel and oxidizer is 1–40%, more narrowly 1–20%, of the combustion conduit volume. The main fuel and oxidizer are then introduced, to substantially fill some fraction (e.g., 20–100%) of the remaining volume of the combustor conduit. The main fuel and oxidizer flows are then shut off. The prior introduction of predetonator fuel and oxidizer past the main fuel/oxidizer ports largely eliminates the risk of the formation of an air or other non-combustible slug between the predetonator and main charges. Such a slug could prevent migration of the combustion front between the two charges.

With the charges introduced, the spark box is triggered to provide a spark discharge of the initiator igniting the predetonator charge. The predetonator charge being selected for very fast combustion chemistry, the initial deflagration quickly transitions to a detonation within the segment 84 and producing a detonation wave. The predetonator effect of encouraging/expediting the transition may be enhanced by changes in internal cross-section. Once such a detonation wave occurs, it is effective to pass through the main charge which might, otherwise, have sufficiently slow chemistry to not detonate within the conduit of its own accord. The wave passes longitudinally downstream and emerges from the downstream end 30 as a shock wave within the furnace interior, impinging upon the surfaces to be cleaned and thermally and mechanically shocking to typically at least loosen the contamination. The wave will be followed by the expulsion of pressurized combustion products from the detonation conduit, the expelled products emerging as a jet from the downstream end 30 and further completing the cleaning process (e.g., removing the loosened material). After or overlapping such venting of combustion products, a purge gas (e.g., air from the same source providing the main oxidizer and/or nitrogen) is introduced through the purge port 100 to drive the final combustion products out and leave the detonation conduit filled with purge gas ready to repeat the cycle (either immediately or at a subsequent regular interval or at a subsequent irregular interval (which may be manually or automatically determined by the control and monitoring system)). Optionally, a baseline flow of the purge gas may be maintained between charge/discharge cycles so as to prevent gas and particulate from the furnace interior from infiltrating upstream and to assist in cooling of the detonation conduit.

Figure 4:
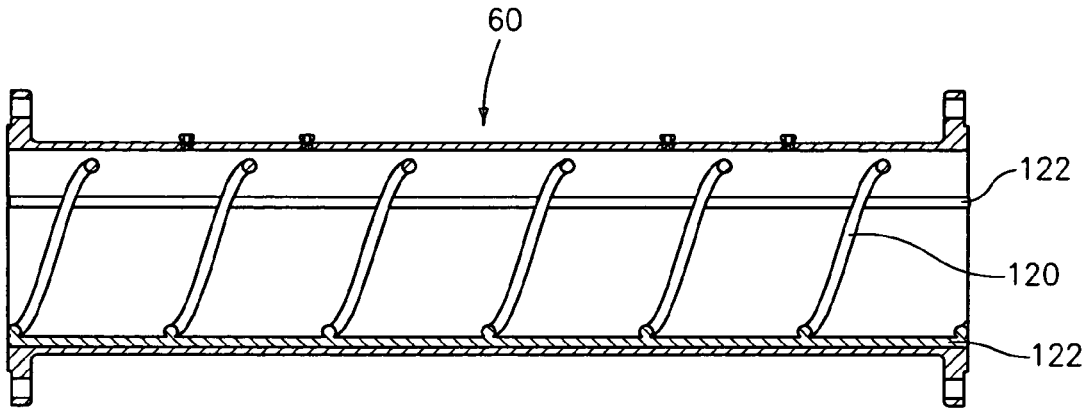
FIG. 4 is a longitudinal sectional view of a main combustor segment of the soot blower of FIG. 2.
Figure 5:
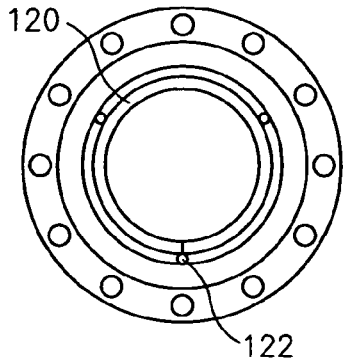
FIG. 5 is an end view of the segment of FIG. 4.

In various implementations, internal surface enhancements may substantially increase internal surface area beyond that provided by the nominally cylindrical and frustoconical segment interior surfaces. The enhancement may be effective to assist in the deflagration-to-detonation transition or in the maintenance of the detonation wave (e.g., to locally or globally compensate for chemistry dilutions such as in a downstream portion of the main charge diluted by remaining purge gas). FIG. 4 shows internal surface enhancements applied to the interior of one of the main segments 60. The exemplary enhancement is nominally a Chin spiral, although other enhancements such as Shchelkin spirals and Smirnov cavities may be utilized. The spiral is formed by a helical member 120. The exemplary member 120 is formed as a circular-sectioned metallic element (e.g., stainless steel wire) of approximately 8–20 mm in sectional diameter. Other sections may alternatively be used. The exemplary member 120 is held spaced-apart from the segment interior surface by a plurality of longitudinal elements 122. The exemplary longitudinal elements are rods of similar section and material to the member 120 and welded thereto and to the interior surface of the associated segment 60. Such enhancements may also be utilized to provide predetonation in lieu of or in addition to the foregoing techniques involving different charges and different combustor cross-sections.

The apparatus may be used in a wide variety of applications. By way of example, just within a typical coal-fired furnace, the apparatus may be applied to: the pendents or secondary superheaters, the convective pass (primary superheaters and the economizer bundles); air preheaters; selective catalyst removers (SCR) scrubbers; the baghouse or electrostatic precipitator; economizer hoppers; ash or other heat/accumulations whether on heat transfer surfaces or elsewhere, and the like. Similar possibilities exist within other applications including oil-fired furnaces, black liquor recovery boilers, biomass boilers, waste reclamation burners (trash burners), and the like.

Figure 6:
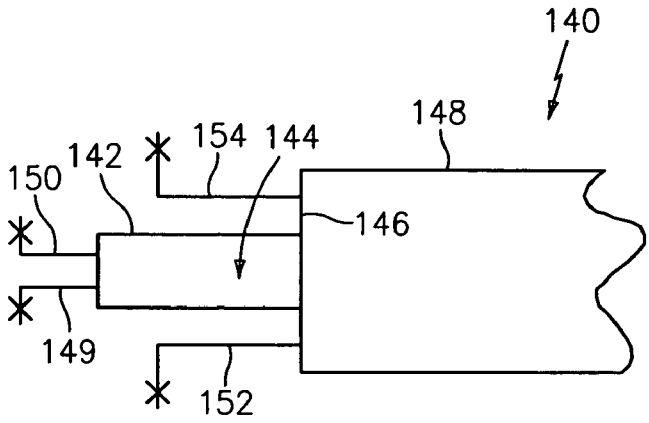
FIG. 6 is a schematic longitudinal sectional view of an upstream end of a first alternate combustion conduit.

FIG. 6 shows an alternate combustion conduit 140 that may be similar to the combustion conduit 26 however having a step change in internal cross-section or diameter instead of the gradual change provided by the transition conduit segment 86. An upstream predetonation conduit segment 142 defines a predetonation volume or chamber 144 separated at its downstream end by an annular radially-extending wall 146 from a main conduit (or segment thereof) 148. Predetonator fuel and oxidizer conduits 149 and 150 are positioned with outlets in an upstream end wall of the conduit 142 and main fuel and oxidizer conduits 152 and 154 (optionally combined) are positioned with ports in the wall 146. Relative diameters and operation may be similar to that of the conduit 26 including, as will be discussed in further detail below, the possible addition of surface enhancements.

Figure 7:
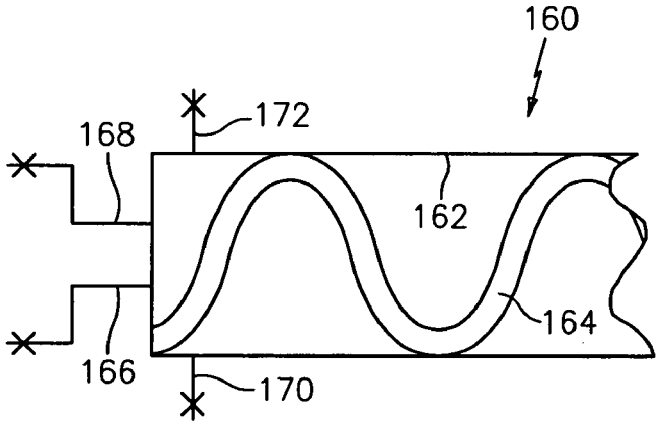
FIG. 7 is a schematic longitudinal sectional view of an upstream end of a second alternate combustion conduit.

FIG. 7 shows an alternate conduit 160 having an upstreammost segment 162 containing a Shchelkin spiral 164. The conduit segment 162 may, otherwise, be of like cross-section to the remaining segments downstream. Predetonator fuel and oxidizer conduits 166 and 168 and main fuel and oxidizer conduits 170 and 172 may be provided. In the exemplary embodiment, the predetonator fuel and oxidizer conduits are in an upstream end wall and the main fuel and oxidizer conduits are in a side wall slightly downstream thereof.

Figure 8:
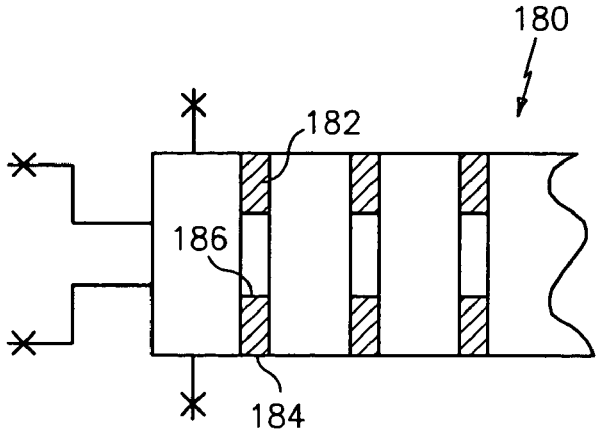
FIG. 8 is a schematic longitudinal sectional view of an upstream end of a third alternate combustion conduit.

FIG. 8 shows an alternate combustion conduit 180 wherein, relative to the conduit 160, the Shchelkin spiral is replaced by a series of orifice plates 182. Each plate 182 has an outer perimeter 184 secured to the interior of the upstreammost conduit segment and a central aperture (orifice) surface 186. Exemplary orifices are circular and represent a minor portion of the internal cross-section of the conduit (e.g., 10–50%). The orifices are sized and the plates positioned to enhance the detonation-to-deflagration transition.

Figure 9:
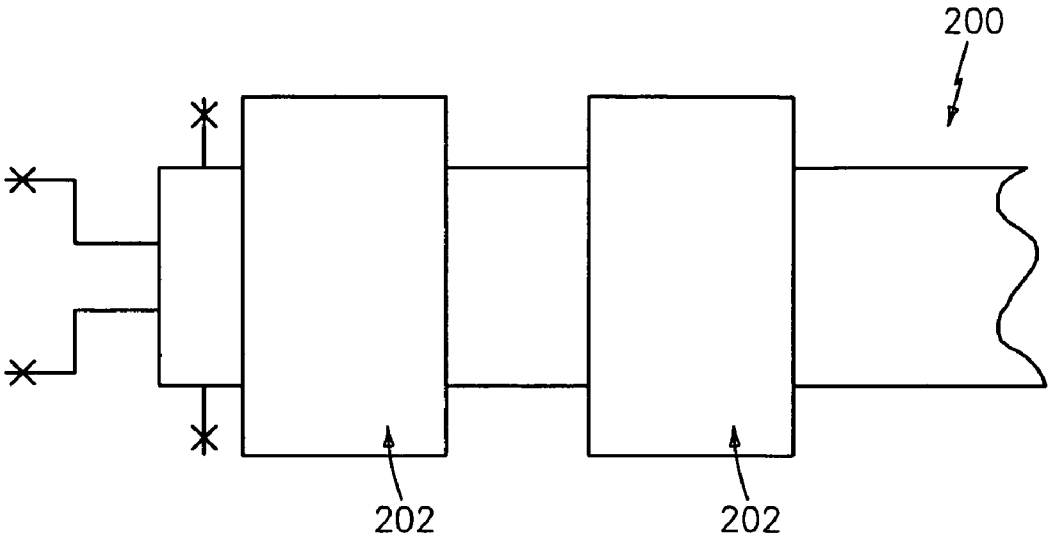
FIG. 9 is a schematic longitudinal sectional view of an upstream end of a fourth alternate combustion conduit.

FIG. 9 shows an alternate conduit 200 having one or more Smirnov cavities 202. In the exemplary embodiment, the cavities represent expansions of cross-sectional area relative to portions upstream of the cavities, between the cavities, and downstream of the cavities. These latter portions may have cross-sectional areas similar to each other. In the illustrated embodiment, there are two Smirnov cavities and the both the predetonator fuel and oxidizer and main fuel and oxidizer are introduced upstream of the cavities.

Figure 10:
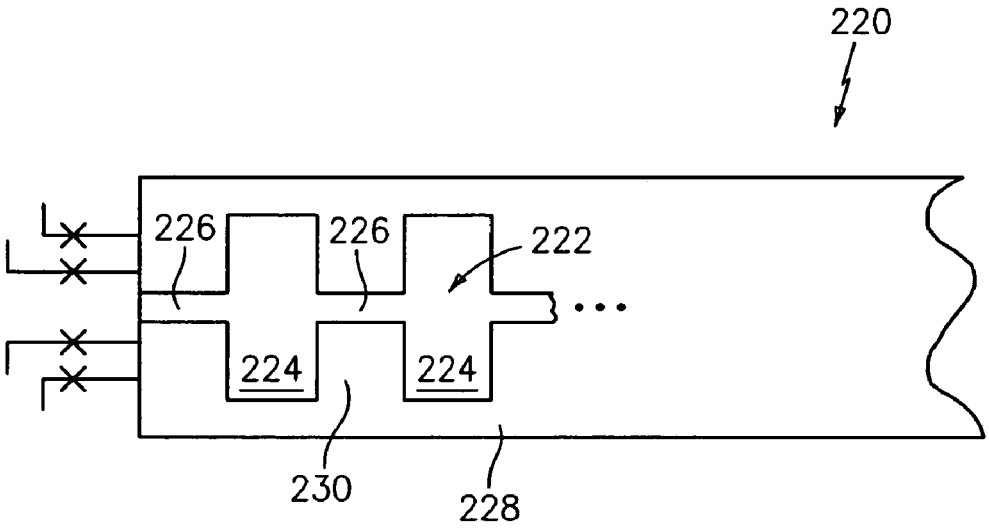
FIG. 10 is a schematic longitudinal sectional view of an upstream end of a fifth alternate combustion conduit.

Providing an effect somewhat similar to those of orifice plates and Smirnov cavities, FIG. 10 shows an alternate combustion conduit 220 wherein a bluff body 222 of longitudinally varying cross-section is positioned within the upstream portion of the conduit. In the exemplary embodiment, the body has one or more large cross-sectional regions 224 separated by small cross-sectional regions 226. The regions 224 and 226 respectively define relatively low and high annular cross-sectional areas 228 and 230. With the exemplary predetonator fuel and oxidizer conduits and main fuel and oxidizer conduits similarly in close longitudinal proximity, the main fuel and oxidizer may first be introduced to essentially fill a desired portion of the combustion conduit whereupon the predetonator fuel and oxidizer are introduced, driving the main charge further downstream proportionally to the desired amount of predetonator charge introduced. The bluff body may be formed in multiple connected pieces or may be formed of separate pieces acting as separate bodies. For example, the body parameters and dimensions may be optimized for a particular application by linking an appropriate number of appropriately relatively sized body pieces providing the large cross-sectional regions on a common shaft extending downstream from the conduit upstream end.

The enhancements of FIGS. 7–10 may also be applied to the stepped or more gradually transitioned internal cross-sectional profiles of FIG. 6 or 2, respectively. For example, the enhancements could be located in the upstream predetonator volume. Alternatively, the enhancements could span the predetonator to main (low and high cross-section) volumes. For example, there might be separate Shchelkin spirals in each of the two volumes or a single Shchelkin spiral might expand itself between the two.

One or more embodiments of the present invention have been described. Nevertheless, it will be understood that various modifications may be made without departing from the spirit and scope of the invention. For example, the invention may be adapted for use with a variety of industrial equipment and with variety of soot blower technologies. Aspects of the existing equipment and technologies may influence aspects of any particular implementation. Other shapes of combustion conduit (e.g., non-straight conduits or sections thereof to navigate external or internal obstacles and non-circular cross-sections of the conduits or sections thereof) may be possible. Accordingly, other embodiments are within the scope of the following claims.

What is claimed is:

1. An apparatus for cleaning a surface within a vessel having a vessel wall separating a vessel exterior from a vessel interior and having a wall aperture, the apparatus comprising:

an elongate conduit having an upstream first end and a downstream second end and positioned to direct a shock wave from the second end into the vessel interior; and a source of fuel and oxidizer coupled to the conduit to deliver the fuel and oxidizer to the conduit; and an initiator, wherein:

the conduit comprises a first portion and a second portion downstream of the first portion;

the first portion has a first characteristic cross-sectional area and the second portion has a second characteristic cross-sectional area, greater than the first characteristic cross-sectional area;

the initiator is positioned to initiate a deflagration in the first portion of the fuel and oxidizer; and the conduit first and second portions are positioned to permit a deflagration-to-detonation transition from said deflagration to produce said shock wave.

2. The apparatus of claim 1 wherein the source comprises:

a first fuel source of a first fuel;

a first oxidizer source of a first oxidizer;

a second fuel source of a second fuel; and a second oxidizer source of a second oxidizer.

3. The apparatus of claim 2 wherein:

the second fuel and oxidizer sources are coupled to the conduit downstream of where the first fuel and oxidizer sources are coupled.

4. The apparatus of claim 1 wherein:

the second portion comprises a plurality of conduit sections secured end-to end and being of essentially constant characteristic diameter; and the first portion includes an upstream portion of essentially constant characteristic diameter and a downstream portion having an essentially downstream increasing diameter.

5. The apparatus of claim 1 wherein:

the first portion comprises an internal surface area enhancement.

6. The apparatus of claim 1 wherein:

the second portion comprises an internal surface area enhancement.

7. The apparatus of claim 1 wherein:

the first portion of the fuel and oxidizer is a minor portion and is more detonable than a major second portion of the fuel and oxidizer.

8. An apparatus for cleaning a surface within a vessel having a vessel wall separating a vessel exterior from a vessel interior and having a wall aperture, the apparatus comprising:

an elongate conduit having an upstream first and a downstream second end and positioned to direct a shock wave from the second end into the vessel interior; and means for introducing first and second fuel/oxidizer mixtures to the conduit and initiating a deflagration of the first mixture so as to produce a deflagration-to-detonation transition from said deflagration and detonate said second mixture to produce said shock wave.

9. The apparatus of claim 8 wherein:

the oxidizer of the first mixture is more oxygen-rich than the oxidizer of the second mixture.

10. The apparatus of claim 8 wherein:

the second fuel/oxidizer mixture is different from the first fuel/oxidizer mixture in chemistry or proportion.

11. The apparatus of claim 8 wherein the means comprises:

a plurality of changes in conduit internal transverse cross-sectional area.

12. A method for cleaning a surface within a vessel, the vessel having a wall with an aperture therein, the method comprising:

providing a first fuel/oxidizer mixture in a first conduit portion;

providing a second fuel/oxidizer mixture, different from the first in chemistry or proportion in a second conduit portion; and initiating a reaction of the first fuel/oxidizer mixture so as to, in turn, cause a detonation of the second fuel/oxidizer mixture so as to cause a shock wave to impinge upon the surface.

13. The method of claim 12 wherein:

the reaction of the first fuel/oxidizer mixture comprises a deflagration-to-detonation transition.

14. The method of claim 12 wherein:

the second mixture is less detonable than the first mixture.

15. The method of claim 12 wherein:

the oxidizer of the second mixture is less oxygen-rich than the oxidizer of the first mixture.

16. The method of claim 12 wherein:

the first fuel/oxidizer mixture is introduced to the first conduit portion as separate fuel and oxidizer components; and the second fuel/oxidizer mixture is introduced premixed to the second conduit portion.

17. The method of claim 12 wherein:

the first fuel/oxidizer mixture is introduced premixed to the first conduit portion; and the second fuel/oxidizer mixture is introduced premixed to the second conduit portion.

18. The method of claim 12 further comprising:

purging the conduit with a purge gas.

19. The method of claim 12 wherein:

the first conduit portion has a characteristic cross-sectional area less than a characteristic cross-sectional area of the second conduit portion.

20. The method of claim 12 wherein:

a major portion of said first fuel/oxidizer mixture is provided before a major portion of said second fuel/oxidizer mixture is provided.

* * * * *